United States Patent [19]

Czerner et al.

[11] 3,931,675

[45] Jan. 13, 1976

[54] ELECTRIC DRY SHAVER WITH RELEASABLE CUTTER HEAD

[75] Inventors: Peter A. Czerner, Trumbull; John F. Daniels, Bridgeport; Maurice A. Melito, Jr., Milford; Edward Szymansky, Fairfield, all of Conn.

[73] Assignee: Sperry Rand Corporation, Bridgeport, Conn.

[22] Filed: June 12, 1974

[21] Appl. No.: 478,715

[52] U.S. Cl. ..... 30/41.6; 30/43.92

[51] Int. Cl.[2] ..... B26B 19/04

[58] Field of Search ..... 30/41, 41.6, 43.1, 43.92

[56] References Cited

UNITED STATES PATENTS

| | | | |
|---|---|---|---|
| 2,780,864 | 2/1957 | Kleinman | 30/41.6 |
| 3,091,850 | 6/1963 | Kleinman | 30/43.92 X |
| 3,348,307 | 10/1967 | Beck et al. | 30/41.6 X |
| 3,552,009 | 1/1971 | Walter | 30/43.1 |
| 3,659,342 | 5/1972 | Kobler | 30/43.1 |
| 3,748,732 | 7/1973 | Frantz et al. | 30/43.1 |

*Primary Examiner*—Harold D. Whitehead
*Assistant Examiner*—Gary L. Smith
*Attorney, Agent, or Firm*—Charles R. Miranda

[57] ABSTRACT

An electric dry shaver wherein the cutter head assembly is held securely within a cutter head receptacle portion thereof by means which includes latch members on the cutter head in latching engagement with a detent spring on the bottom wall of the receptacle. Additional means are provided for pivoting the receptacle away from the casing for presenting the detent spring in position to release the cutter head or clean the adjacent casing area.

12 Claims, 9 Drawing Figures

Fig. 8.
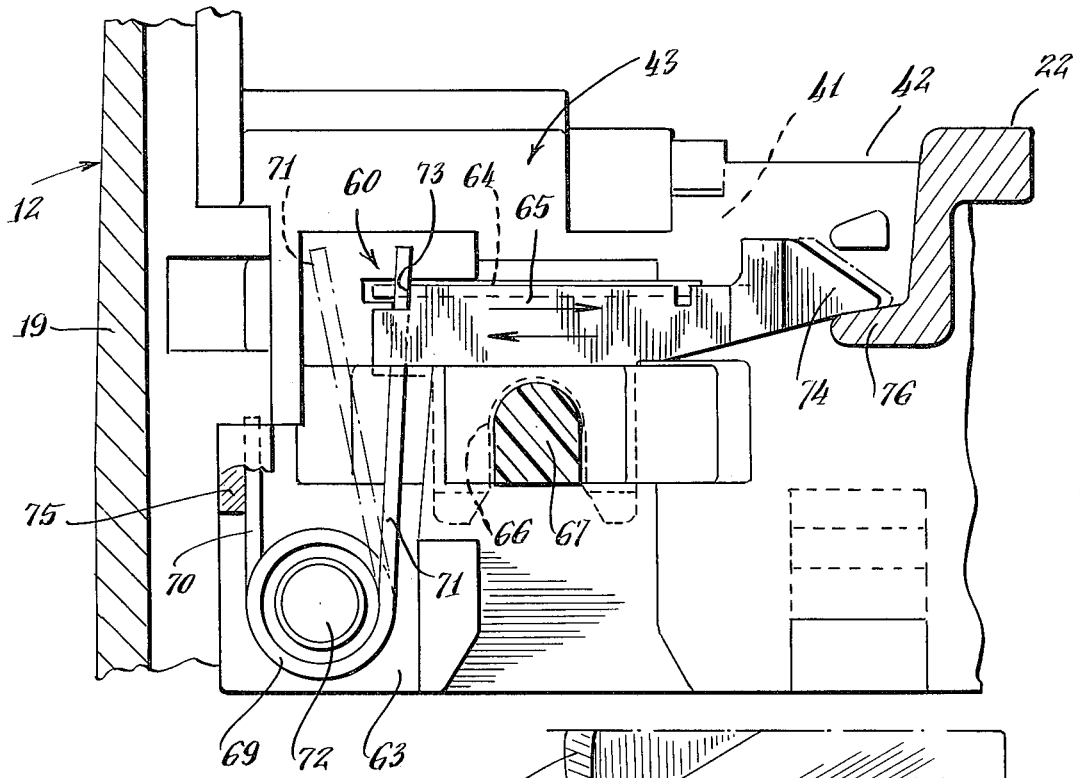
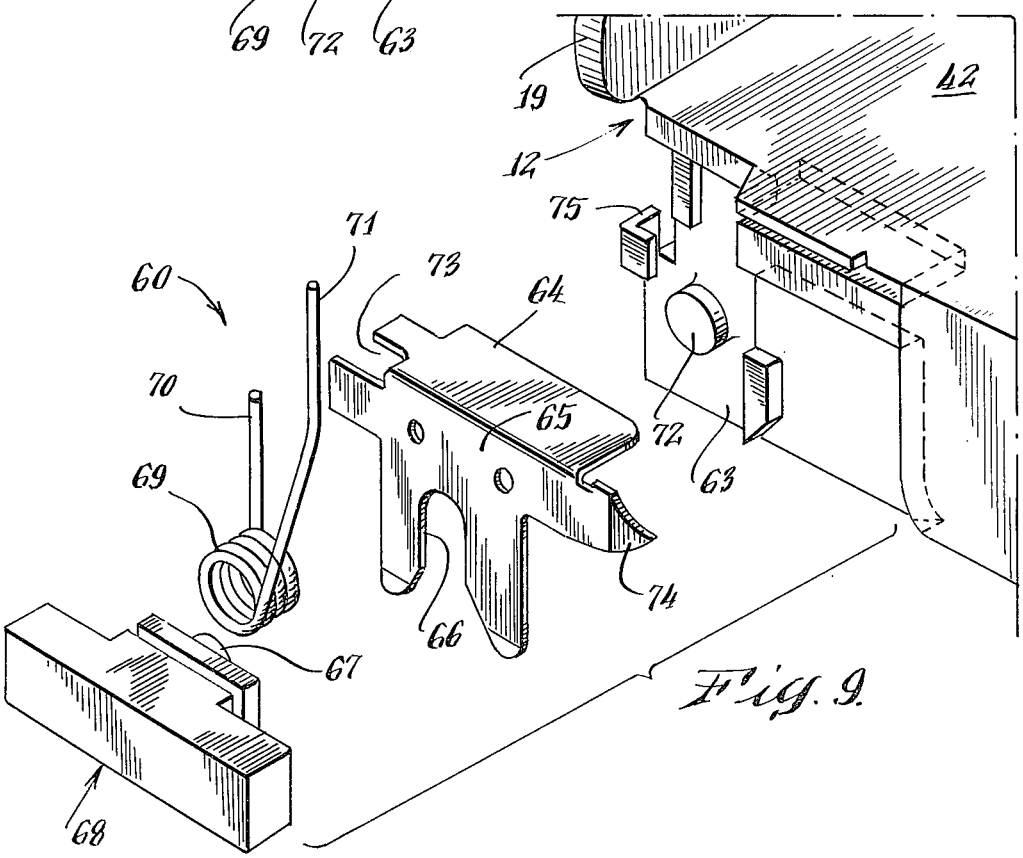
Fig. 9.

ELECTRIC DRY SHAVER WITH RELEASABLE CUTTER HEAD

BACKGROUND OF THE INVENTION

This invention relates to new and useful improvements in electric dry shavers and in particular to means for mounting a cutter head assembly on or within the shaver casing.

In electric dry shavers it is the usual practice to provide means for detachably mounting the cutter head assembly on the shaver casing whereby the former is readily removable therefrom for cleaning or replacing the various parts of the cutter head assembly. Further, in the course of shaving debris such as hair clippings, facial powder and other matter will collect beneath, within and adjacent the cutter head assembly. In order for proper operation of the electric dry shaver these accumulations must be periodically removed by brushing or similar methods. Also in shavers utilizing multiple cutter head units where each unit comprises a stationary outer cutter and a movable inner cutter, the latter cutter must be replaced from time to time to maintain proper cutting efficiency of the cutter head assembly.

In known electric dry shavers, although means comprising various structural arrangements have been provided for accomplishing these objectives both individually and in combination, there has not been found in one electric dry shaver the simplicity that is required to provide access to the cutter head assembly in daily use of the shaver for both cleaning and replacing. In some shavers, for example, the cutter head is held to the casing by spring clips and a removable hair pocket is disposed over the cutter head which must be removed to obtain access to the cutter head. In other shavers means are provided for latching the cutter head to the casing with other means provided for manually releasing the shaver head from a latched position to a position partially ejected from the casing for removal therefrom. In other type shavers means are provided for elevating the cutter head clear of the cutter drive mechanism or of the casing for cleaning or removal of the inner cutters. In still other shavers the cutter head is hinged to the casing and is adapted to be pivoted away therefrom upon actuation of latch releasing mechanisms.

These arrangements although satisfactory in use, require removal of parts from the casing or the like for cleaning the cutter head area and releasing the cutter head. Further the known means for latching the cutter head assembly in these shavers is not readily accessible for operation. The excessive manipulations in obtaining access to the areas to be cleaned and releasing the cutter head is often avoided by the user in daily use of the shaver which results in inefficient operation of the shaver.

It is an object of the present invention to provide novel means for mounting a cutter head assembly on a shaver casing.

Another object is to provide novel means for securing cutter head assembly within a shaver casing which does not interfere with the other mechanisms within the casing.

Another object is to provide novel means for permitting ready access to a cutter head and adjacent areas within the casing for cleaning and servicing of the cutter head assembly.

A still further object is to provide a novel arrangement for attaching a cutter head assembly within the casing wherein the cutter head and attachment means is protected by adjacent casing structure.

SUMMARY OF THE INVENTION

The present invention contemplates an electric dry shaver having novel means for mounting a cutter head assembly on the casing and for providing ready access thereto for servicing. In one embodiment the cutter head assembly comprises a multiple cutter head unit having a plurality of cutter units mounted on a single support plate. The cutter head assembly is disposed in a cutter head receptacle casing portion of the shaver casing provided in the upper hairpocket section thereof with the cutter head support plate disposed upon a bottom wall portion of the receptacle. Latch members extend from the support plate through openings in the bottom wall and in mounted position of the cutter head assembly have portions in latching engagement with a detent spring secured to the opposite surface of the bottom wall of the receptacle. The hairpocket is hinged clear of the main casing and means are provided locking the hairpocket thereto with manually operable means accessible for pivoting the hairpocket and cutter head away from the receptacle whereat the cutter head is pivoted clear of the cutter head drive mechanism and where the cutter head attachment means is accessible for unlatching the cutter head assembly.

The above and other objects and advantages of the present invention will appear more fully hereinafter from a consideration of the detailed description which follows taken together with the accompanying drawings wherein an embodiment of the invention is illustrated.

DESCRIPTION OF THE DRAWINGS

In the drawings:

FIG. 8 is a fragmentary sectional view taken on the line 8—8 of FIG. 3; and FIG. 9 is an exploded perspective view of the hairpocket locking mechanism shown in exploded relationship.

DESCRIPTION OF THE PREFERRED EMBODIMENT

Figure 1:
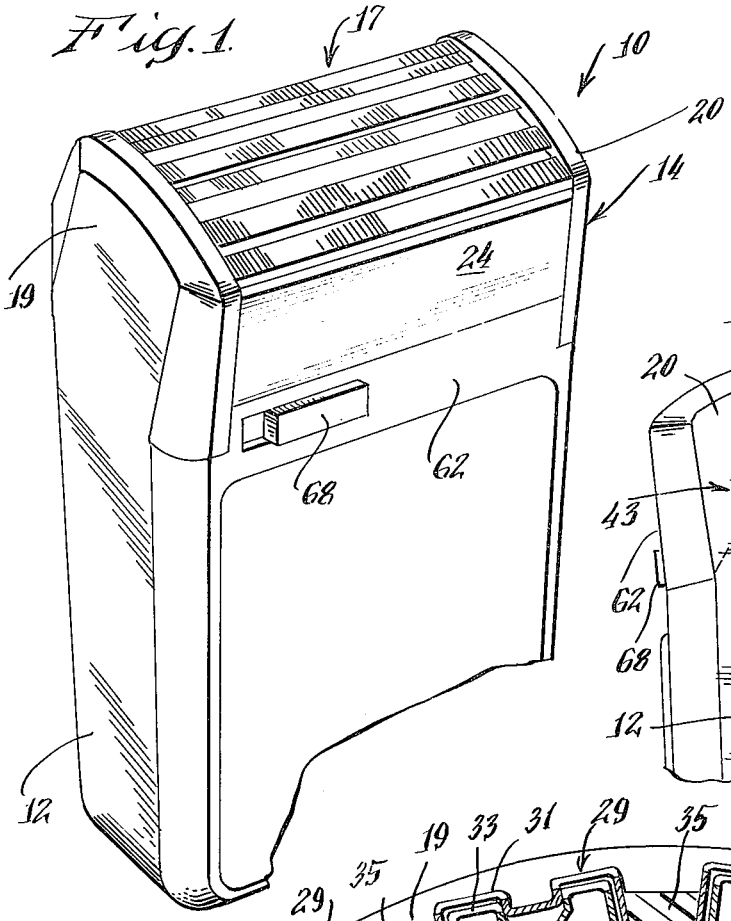
FIG. 1 is a perspective view of an electric dry shaver in which is incorporated an embodiment of the present invention.
Figure 2:
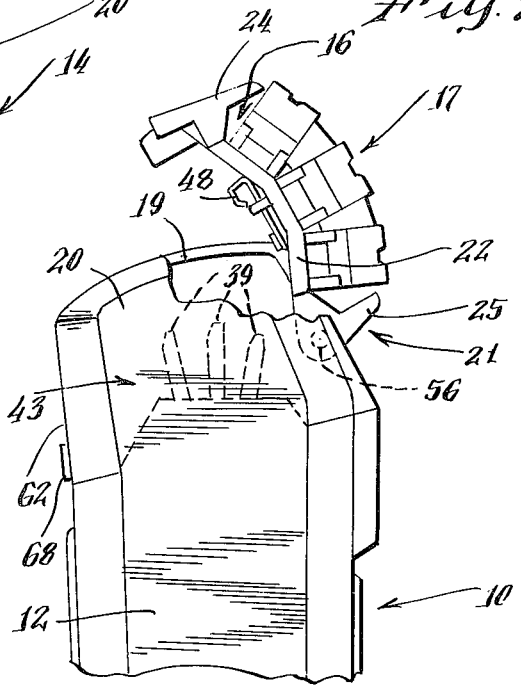
FIG. 2 is a fragmentary side elevational view of the upper portion of the electric dry shaver of FIG. 1 with the cutter head assembly pivoted clear of the cutter head receptacle.
Figure 3:
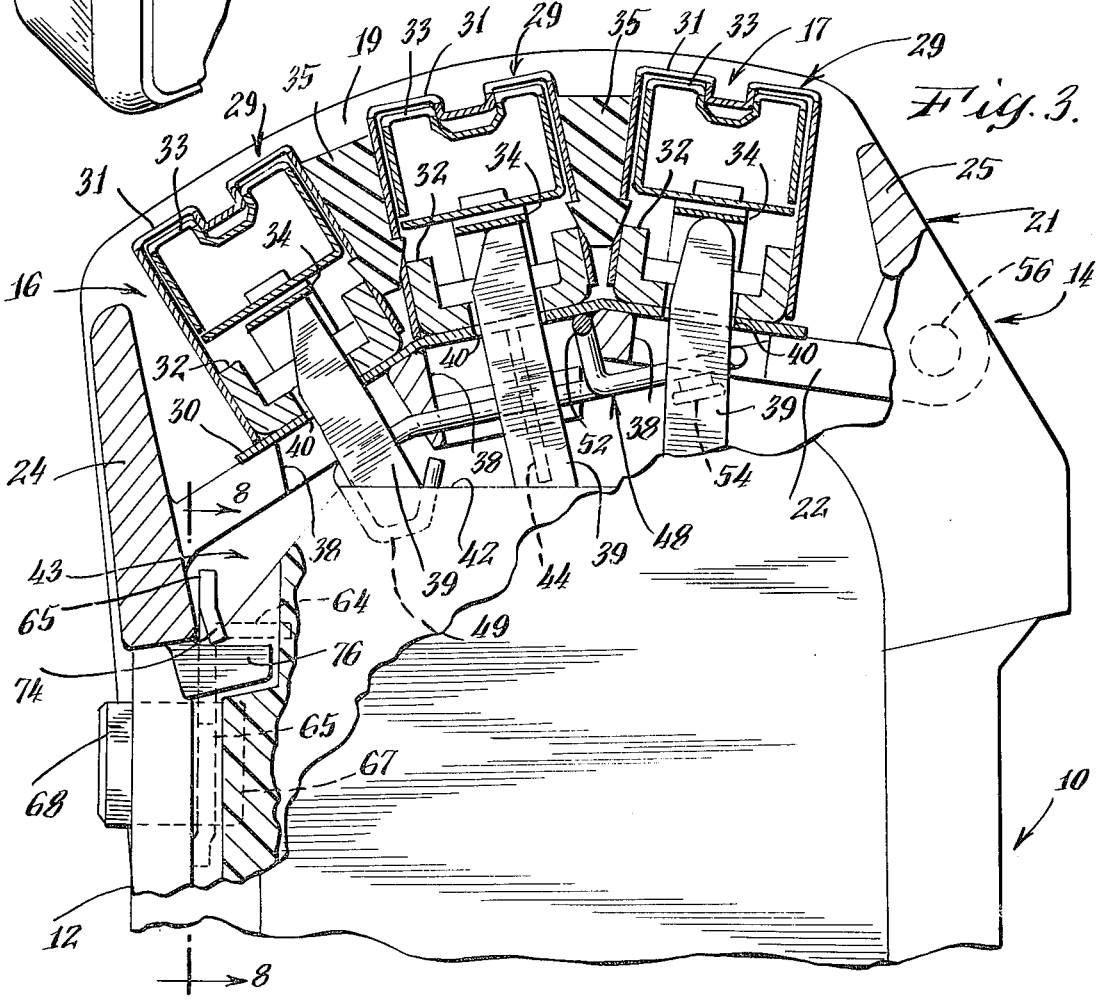
FIG. 3 is an enlarged side elevational sectional view of the cutter head receptacle and cutter head assembly.

Referring now to the drawings for a more detailed description of the present invention, an electric dry shaver is generally indicated by the reference numeral 10 in FIGS. 1, 2 and 3. Electric shaver 10 comprises a main body portion or enclosure 12 and an upper hairpocket section 14 both of which are formed of molded plastic. A cutter head receptacle 16 is provided in hairpocket 14 in which is disposed a cutter head assembly 17 which is operated by a drive mechanism in a well-known manner comprising oscillator arms 39 which are powered by a motor (not shown) disposed within main body portion 12 in a conventional manner.

Cutter head receptacle 16 comprises a pair of spaced end walls 19 and 20 which rise upwardly from main body section 12. A cutter head supporting section 21 within receptacle 16 includes a bottom wall 22 and front and rear walls 24 and 25. Cutter head assembly 17 is disposed in receptacle 16 upon bottom wall 22 and has exposed upper portions arranged substantially flush with the upper edges of end walls 19 and 20 and front and rear walls 24 and 25.

Cutter head assembly 17 includes three individual and identical cutter head units 29 and which units are of a well-known structure. Cutter units 29 are disposed in side by side relationship on a substantially rectangular metallic mounting plate 30 which is slightly convex in cross-sectional configuration. Each cutter head unit 29 includes an inverted U-shaped outer cutter 31 having opposite sidewall portions secured to the arms of a U-shaped base spacer 32. An inner cutter 33 of the general type shown and described in U.S. Pat. No. 2,793,430 issued on May 28, 1957 to L. C. Carissimi is disposed within each outer cutter 31 and is urged in cutting association against the outer cutter 31 by a leaf spring 34 as shown in FIG. 3. Suitable fastening means (not shown) are provided for securing the cutter head units 29 to mounting plate 30 and may include suitable clamp members or other well-known means for maintaining the cutter head units 29 thereon.

In addition skin engaging bar members 35 are disposed intermediate adjacent cutter units 29 and are secured to mounting plate 30 by suitable fastening means (not shown).

Cutter head assembly 17 is disposed in cutter head receptacle 16 and seated upon wall portion 22 of cutter supporting section 21. Wall portion 22 is provided with an opening 38 through which extend oscillator arms 39 from the motor compartment in main enclosure 12. Arms 39 also project through openings 40 in the cutter head assembly to bias springs 32 of the inner cutters in the usual manner into cutting cooperation with outer cutters 31. Upper wall 42 of enclosure 12 provides the lower floor of an area designated at 43 in FIGS. 2 and 3 beneath wall 22 of cutter head receptacle whereat hair clippings or the like will accumulate.

As mentioned it is a feature of the present invention to provide novel means for attaching cutter head assembly 17 to shaver casing 12 within receptacle 16. To this end, spaced depending latch members 44 and 46 (FIGS. 4 and 5) are formed on the bottom of mounting plate 30 and project downwardly through openings 40 in wall portion 22 of cutter supporting section 21 at opposite sides of the center motor oscillator arm 39.

Figure 4:
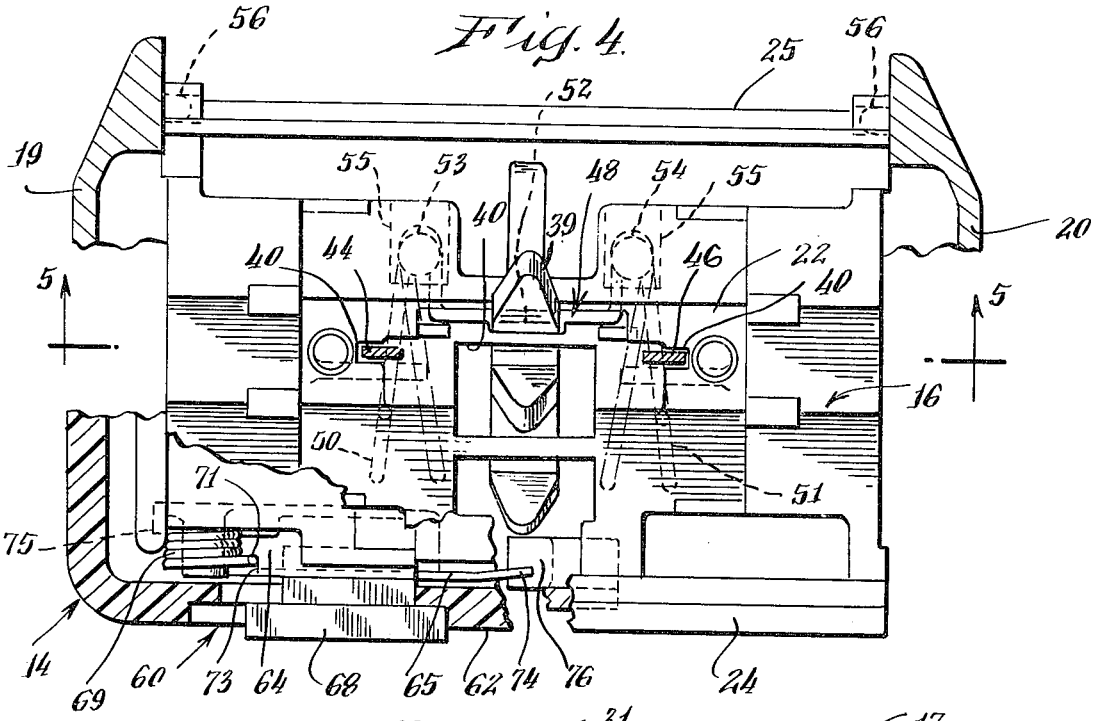
FIG. 4 is a plan view of the cutter head receptacle with the cutter head assembly removed therefrom.
Figure 5:
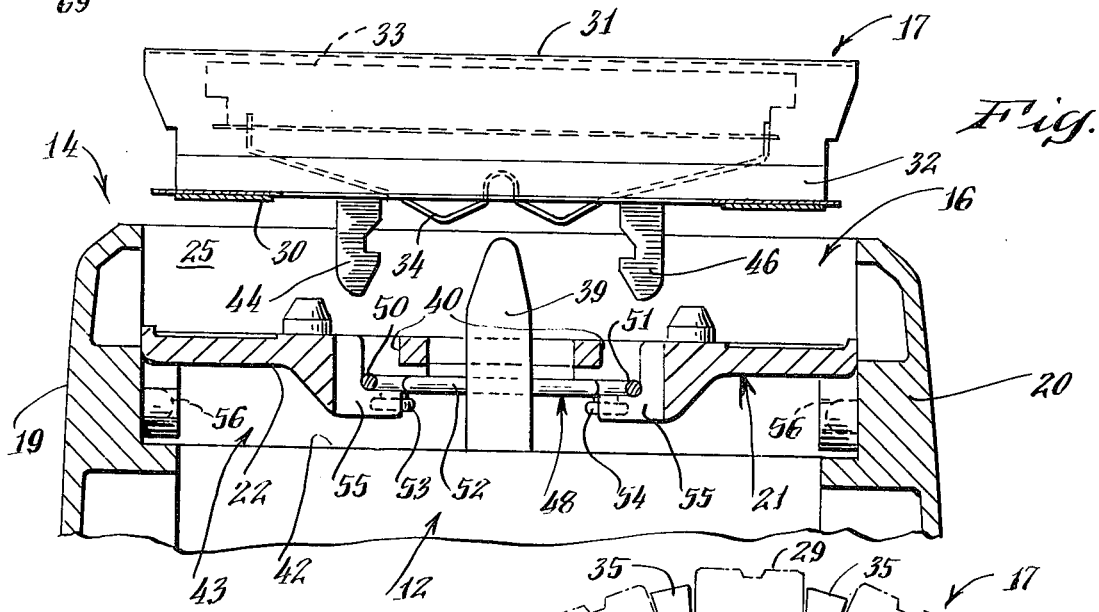
FIG. 5 is a sectional view taken on the line 5—5 of FIG. 4 and shows the cutter head assembly in a released relationship relative to the cutter head receptacle.
Figure 6:
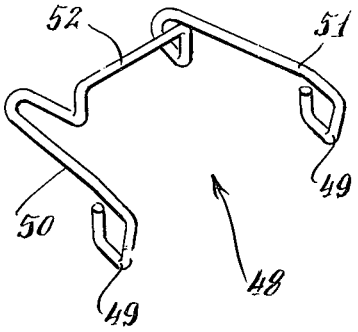
FIG. 6 is a perspective view of the cutter head detent spring.

Detent means are provided for holding latch members 44 and 46 in a manner whereby cutter head assembly 17 is secured in operative position within cutter head receptacle 16 and which means comprise a U-shaped spring member 48. Spring member 48 has opposite arms 50, 51 and an intermediate bight portion 52. Bight portion 52 of spring 48 is looped around depending port projections 53 and 54 on bottom wall portion 22 (FIGS. 4, 5, and 6). Arms 50–51 of spring 48 are biased outwardly against spaced abutments 55 of wall portion 22 arranged adjacent the central open 38 therein. In this manner when cutter head assembly 17 is seated in receptacle 16 latch members 44–46 extend below wall 22 into latching engagement with portions of arms 50–51 (FIG. 4) of spring 48.

As seen in FIG. 2 cutter head assembly 17 and cutter head supporting section 21 are pivotable away from casing 12 clear of end walls 19 and 20. To accomplish this rear wall 25 of section 21 is hinged by means of pins 56 in the lower corners of end wall 19 and 20 fitted in the lower adjacent corners of rear wall 25. In this manner section 21 is pivotable on hinge pins 56 toward or away from upper wall 42 of enclosure 12 and the debris collecting area 43.

A locking mechanism for locking pivotable section 21 to enclosure 12 is generally indicated by the reference numeral 60 in FIGS. 8 and 9. Locking mechanism 60 is disposed between front wall 62 (FIG. 1) of enclosure 12 and an extension 63 of upper wall portion 42 and includes a slidable locking member 65 having a central recess 66 fitted in secured position over a shaft portion 67 of release button 68 which extends from the outer surface of wall 62 into casing 12. A marginal portion 64 of member 65 is bent at a right angle thereto and is positioned on wall 42 for slidable movement thereon.

Locking mechanism 60 further includes a spring member 69 having a pair of arms 70–71 and a base portion looped about a boss 72 on extension 63 to position the spring within the casing. One arm 71 of spring 69 is biased into engagement with locking member 65 within a recess 73 therein and arm 70 is urged against projection 75 on extension 63. In this manner latch end 74 of member 65 is urged into cammed latching engagement with projection 76 on bottom wall 22 of cutter head support section 21.

In accordance with the above described structure and with the cutter head assembly 17 mounted on cutter head support structure, let it be assumed a person desires to remove cutter head assembly 17 from the shaver. First release button 68 is moved to the left as viewed in FIG. 8 releasing latch end 74 from projection 76. The biasing of inner cutter springs 34 by oscillator arms 39 cause section 21 to pivot about hinge pins 56 away from enclosure section 12 to the position shown in FIG. 2 clear of oscillator arms 39. In this position the area 43 may be cleaned of debris by brushing or the like. Further, end portions 49 of arms 50–51 of cutter head detent spring 48 can be pressed together releasing latch hooks 44–46 from arms 50–51 and freeing cutter head assembly from support section 21.

Figure 7:
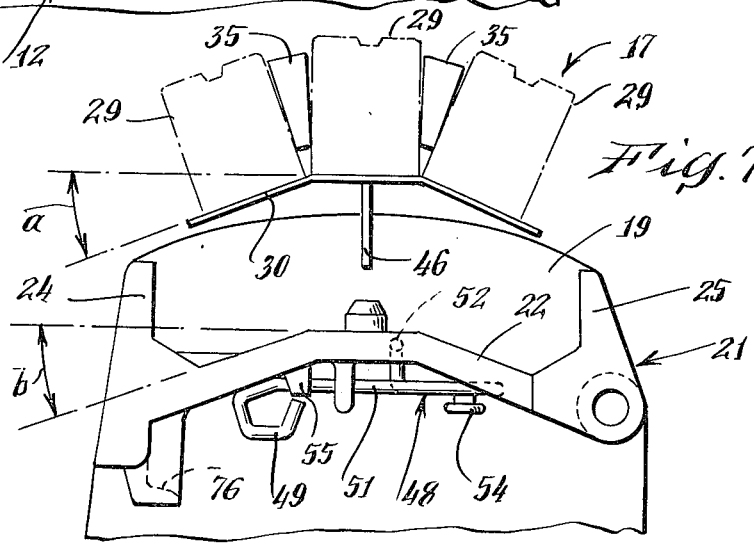
FIG. 7 is a side view of the shaver as seen in FIG. 5.

If it is desired to restore cutter head assembly 17 to shaver 10 a reverse procedure is followed. Cutter head 17 is inserted into receptacle 16 reinserting latch projections 44–46 into openings 40 camming against and then snapping into latching engagement with arms 50–51 as cutter head mounting plate 30 seats on wall 22. As cutter head 17 is thus returned to latched position the slightly greater convex configuration of mounting plate 30 engages the lesser convex shaped surface of wall 22. The latter difference in configuration as designated by the greater and lesser angles *a* and *b* respectively in FIG. 7 and cause mounting plate 30 to flex slightly causing the outer most cutter units 29 thereon to move into closer engagement with adjacent skin bars 35 thereby effecting a tighter locking engagement of cutter head assembly 17 to wall 22 of cutter support section 21.

In a similar reverse manner support section 21 may be then pivoted on hinge pins 56 back into locked position relative to enclosure casing 12 with projection 75 on wall 22 camming into latching engagement with locking member 65 against the bias of spring 69.

It will be apparent from the foregoing description of the novel attachment means described has many advantages in use. One advantage is that the cutter head area 43 is readily accessible for cleaning without removing the cutter head assembly 17 from casing 12 by utilization of latch mechanism 60 as described. Further, if desired the cutter head assembly can be readily removed by releasing detent spring 48 in the unlatched position of the support section 21. In addition in pivoted position of cutter support section 21 the inner cutters 33 can be removed from the cutter assembly without disturbing the detent spring 48 and the cutter head assembly is in a position clear of the oscillator arms 39.

Although one embodiment of the present invention has been illustrated and described in detail it is to be expressly understood that the invention is not limited thereto. Various changes can be made in the design and arrangement of parts without departing from the spirit and scope of the invention as the same will now be understood by those skilled in the art.

What is claimed is:

1. Cutter head attachment means for an electric dry shaver, comprising:

a. a casing having a main body portion and a cutter head supporting section mounted on said main body portion, b. means mounting said cutter head section, for separation from said main body portion, c. said cutter head section including a bottom wall extending between a pair of opposed side walls, d. a cutter head assembly including a cutter unit support plate disposed upon one side of said bottom wall of said cutter head section, e. latch means on said support plate projecting through said bottom wall, f. detent means on the opposite side of said bottom wall for detenting said latch means, and g. said detent means having means for releasing said support plate from said bottom wall when said cutter head section is in the separated position.

2. The device of claim 1 wherein said cutter head assembly includes at least one cutter head unit having an inner cutter and an outer cutter, said latch means including a latch extension of said support plate projecting from said cutter head unit through said bottom wall said detent means including a spring having an arm portion biased into engagement with said latch extension for latching said plate to said bottom wall, and means on said spring for releasing said arm portion from the latched position.

3. The device of claim 2 wherein said cutter head assembly includes a plurality of said cutter units mounted on said support plate, said latching means including at least two of said latch extensions projecting from said plate, and said detent means including a U-shaped spring having a bight portion and a pair of opposed arm portions said bight portion secured to said bottom wall and each of said opposed arm portions biased into engagement with the latch extensions.

4. The device of claim 3 wherein said support plate for mounting said cutter units is formed from a resilient material and is adapted to flex upon engagement with said bottom wall to cause at least two of said cutter units to flex relative to each other to further assist in said latching engagement of said latch extensions with said spring arm portions.

5. The device of claim 1 wherein said means for mounting said cutter head section includes means hinging said cutter support section to the main casing and second latch means securing said cutter head section to the main body portion and operable to release said section to the separated position.

6. The device of claim 5 wherein said second latch means includes a depending projection from said cutter head section, a slide latch member on said main body portion, and spring means adapted to urge said slide latch member into latching engagement with said projection.

7. In an electric dry shaver having a casing and a cutter head receptacle in said casing, a. said receptacle including a bottom wall between a pair of opposed side walls, b. a cutter head assembly including a plurality of cutter head units secured to a mounting plate, c. said cutter head assembly disposed in said cutter head receptacle on one side of said bottom wall thereof, d. latch means on said mounting plate extending through said bottom wall, e. detent means on the opposite side of said bottom wall and including means in engagement with said latch means for releasably securing said cutter head assembly within the receptacle, and f. means for releasing said bottom wall from the casing whereat said detent means are manually operable to unlatch said cutter head assembly.

8. The device of claim 7 wherein openings are provided in said bottom wall through which project drive means for said cutter head assembly, said latch means including latch projections on said mounting plate depending through one of said openings, said detent means including a U-shaped spring secured to the opposite side of said bottom wall and having opposite arms thereof biased into engagement with said latch projection.

9. The device of claim 7 wherein said cutter head assembly includes at least two cutter head units, and wherein said mounting plate is adapted to flex upon engaging said one side of said bottom wall in latched position of said assembly to bias said at least two cutter head units toward each other and thereby further assist in said latching engagement.

10. The device of claim 9 wherein said bottom wall is convex in cross-sectional configuration and wherein said mounting plate is of similar configuration of lesser dimension to cause said plate to flex when seated on said bottom wall.

11. The device of claim 7 wherein said detent means includes U-shaped spring having the bight portion secured to the said opposite side of said cutter head receptacle bottom wall, opposite arms of said spring biased into engagement with said latch means, and means on said arms accessible in the released position of the bottom wall for manually releasing said arms from the latch means.

12. The device of claim 7 wherein said bottom wall is hinged to said casing and wherein said bottom wall releasing means include second latch means for releasably securing said wall portion to the casing.

* * * * *